US010654617B2

(12) United States Patent
Hoffmann et al.

(10) Patent No.: US 10,654,617 B2
(45) Date of Patent: May 19, 2020

(54) CONTAINER AND METHOD FOR PRODUCING A CONTAINER OF SAID TYPE

(71) Applicant: KHS GmbH, Dortmund (DE)

(72) Inventors: Uwe Hoffmann, Böbingen an der Rems (DE); Mathias Fischer, Weeze (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 15/570,495

(22) PCT Filed: Apr. 26, 2016

(86) PCT No.: PCT/EP2016/059240
§ 371 (c)(1),
(2) Date: Oct. 30, 2017

(87) PCT Pub. No.: WO2016/174007
PCT Pub. Date: Nov. 3, 2016

(65) Prior Publication Data

US 2018/0141711 A1 May 24, 2018

(30) Foreign Application Priority Data

Apr. 29, 2015 (DE) ..... 10 2015 106 665

(51) Int. Cl.
*B65D 21/02* (2006.01)
*B65D 25/28* (2006.01)

(52) U.S. Cl.
CPC ..... *B65D 21/0205* (2013.01); *B65D 25/28* (2013.01)

(58) Field of Classification Search
CPC ..... B65D 21/0205; B65D 71/50; B65D 2571/00; B65D 25/2873; B65D 25/28
See application file for complete search history.

(56) References Cited

U.S. PATENT DOCUMENTS

| | | | | |
|---|---|---|---|---|
| 3,893,725 | A * | 7/1975 | Coulter | B65D 45/02 292/258 |
| 5,570,833 | A * | 11/1996 | Dusek | B42F 15/04 229/67.2 |
| 7,726,464 | B2 | 6/2010 | Cerf | |
| 2014/0159506 | A1* | 6/2014 | Kim | H02M 3/1584 307/126 |
| 2014/0238881 | A1* | 8/2014 | Stuhlmann | B65D 71/50 206/428 |
| 2015/0367981 | A1* | 12/2015 | Moore | B65D 25/2873 229/117.22 |

FOREIGN PATENT DOCUMENTS

| | | |
|---|---|---|
| CH | 505 588 | 4/1971 |
| CN | 102030142 | 4/2011 |

(Continued)

*Primary Examiner* — Shawn M Braden
(74) *Attorney, Agent, or Firm* — Occhiuti & Rohlicek LLP

(57) ABSTRACT

A container group having at least two adjacent containers includes a band-like carrier-element that forms a loop-like carrying-handle having free-ends with connecting sections, one of which has a pull-off tab that connects to a corresponding connecting-section. Surfaces of said adjacent containers within the group form contact areas that are detachably connected by an adhesive layer. The first and second connecting-sections connect the loop-like carrying handle to the containers.

19 Claims, 5 Drawing Sheets

(56) References Cited

FOREIGN PATENT DOCUMENTS

| | | |
|---|---|---|
| CN | 103648915 | 3/2014 |
| DE | 41 26 212 | 2/1993 |
| DE | 10 2009 025 824 | 11/2010 |
| DE | 10 2009 044 271 | 4/2011 |
| DE | 10 2011 107 264 | 1/2013 |
| DE | 10 2011 107 265 | 1/2013 |
| DE | 10 2013 107574 | 1/2015 |
| JP | H01061065 | 4/1989 |
| JP | H06503788 | 4/1994 |
| JP | 2002211633 | 7/2002 |
| JP | 2011255948 | 12/2011 |
| WO | WO2013/004337 | 1/2013 |
| WO | WO2013/004341 | 1/2013 |
| WO | WO 2015/007532 | 1/2015 |

* cited by examiner

CONTAINER AND METHOD FOR PRODUCING A CONTAINER OF SAID TYPE

RELATED APPLICATIONS

This application is the national stage of PCT/EP2016/059240, filed on Apr. 26, 2016, which claims the benefit of the Apr. 29, 2015 priority date of German application DE 10-2015 106665.3

FIELD OF INVENTION

The invention concerns packaging, and in particular container groups.

BACKGROUND

Containers, such as bottles, are usually formed into groups for retail sales. A common way to join containers into a group it to use shrink-wrap. However, a disadvantage of shrink-wrap is that the shrink film must be heated. This heating step consumes copious amounts of energy.

An alternative to shrink-wrap is to strap containers into container group. In some cases, the strap can even be glued to one or more of the containers. This avoids the energy use of shrink-wrapping. However, this type of container group becomes unstable when even one container is removed.

Another way to make a container group is to glue containers together. This avoids the foregoing problems. To make it easier to carry a container group, it is known to glue a carry handle to the group. Such handles are often difficult to remove.

SUMMARY

In one aspect, the invention features a container-group formed of at least two containers from which it is easy to remove the carrying handle. Such a container-group features a loop-like carrying handle having a pull-off tab on a free end of a band-like carrier element. The pull-off tab connects to a connecting section and b makes it possible to remove the loop-like carrying handle, which is bonded directly to a container wall, particularly easily and rapidly.

Some embodiments feature a folding edge formed at a free end between the connecting section and the pull-off tab adjoining it. Among these embodiments are those in which the pull-off tab projects at the folding edge from the outer shell surface. A suitable projection angle is between 0 and 180 degrees, and preferably between 5 and 90 degrees. This simplifies gripping the pull-off tab.

In some embodiments, the band-like carrier element comprises an underside with an adhesive strip provided at least in the region of the connecting section. This adhesive strip connects the corresponding connecting section directly to a container's outer surface.

In some embodiments, folding the free end of the band-like carrier element in its longitudinal direction produces the pull-off tab.

In other embodiments, the adhesive layer extends over the full surface of the free end of the band-like carrier element in such a way that folding the free end in the longitudinal direction of the band-like carrier element forms both the pull-off tab and the adjoining connecting section, which also comprises an adhesive layer.

In some embodiments, the connecting section connects directly to the corresponding outer shell surface by an adhesive layer arranged at the outer shell surface of a corresponding container.

In one embodiment, the pull-off tab is formed as one piece or one part with the carrier element.

In another embodiment, the band-like carrier element comprises an adhesive layer with an additional material piece arranged on it on at least one free end in the region of the pull-off tab.

Another aspect of the invention features method for producing a container group that includes at least two containers, each with has a container surface, and forming wherein at least one contact or touch surface between surfaces of adjacent containers. An adhesive layer at these contact surfaces permits the containers to be detachably connected by the adhesive layer. A band-like carrier element forms at least one loop-like carrying handle with free ends. These free ends connect directly to a container's surface by way of respective connecting sections. In some embodiments, the band-like carrier element connects at one free end to the container's surface to form a pull-off tab at the free end. This pull-off tab connects to the connecting section.

As used herein, the term "container" refers to bottles, cans, tubes, pouches, in each case made of metal, glass, and/or plastic, as well as soft packages, for example such as those produced from cardboard and/or plastic film and/or metal film. Preferably, such containers are rotationally symmetrical.

As used herein, "adhesive" includes glue and all materials or compounds with which an adhesive connection between containers and between containers and a handle is possible. Adhesives include materials that, when applied in a fluid or viscous state, form a self-adhesive layer. Adhesives also include materials that cause an adhesive bond when certain conditions occur. These conditions include application of pressure and application of energy for causing hardening, cross-linking, and/or an adhesive bond. Application of energy includes application of electromagnetic energy and/or heat. In some cases, an "adhesive" includes a carrier material that is coated with a material with which an adhesive bond between containers is possible, for example by applying adhesive on at least two sides.

Expressions such as "essentially," "about," or "approximately" signify deviations from the exact value by ±10%, preferably ±5%, and/or deviations in the form of changes that are not of significance to the function.

Further embodiments, advantages, and possible applications of the invention are also derived from the following description of exemplary embodiments and from the figures. In this situation, all the features described and/or illustrated are in principle, alone or in combination, the object of the invention, irrespective of their association in the claims or reference to them. The content of the claims are also made a constituent part of the description.

BRIEF DESCRIPTION OF THE DRAWINGS

The invention is explained in greater detail hereinafter by way of exemplary embodiments, on the basis of the figures, in which.

For elements of the invention that are the same or have the same effect, identical reference numbers are used in the figures. Moreover, for the sake of easier overview, only those reference numbers that are useful for the description of a figure are shown in that figure.

DETAILED DESCRIPTION

Figure 1A:
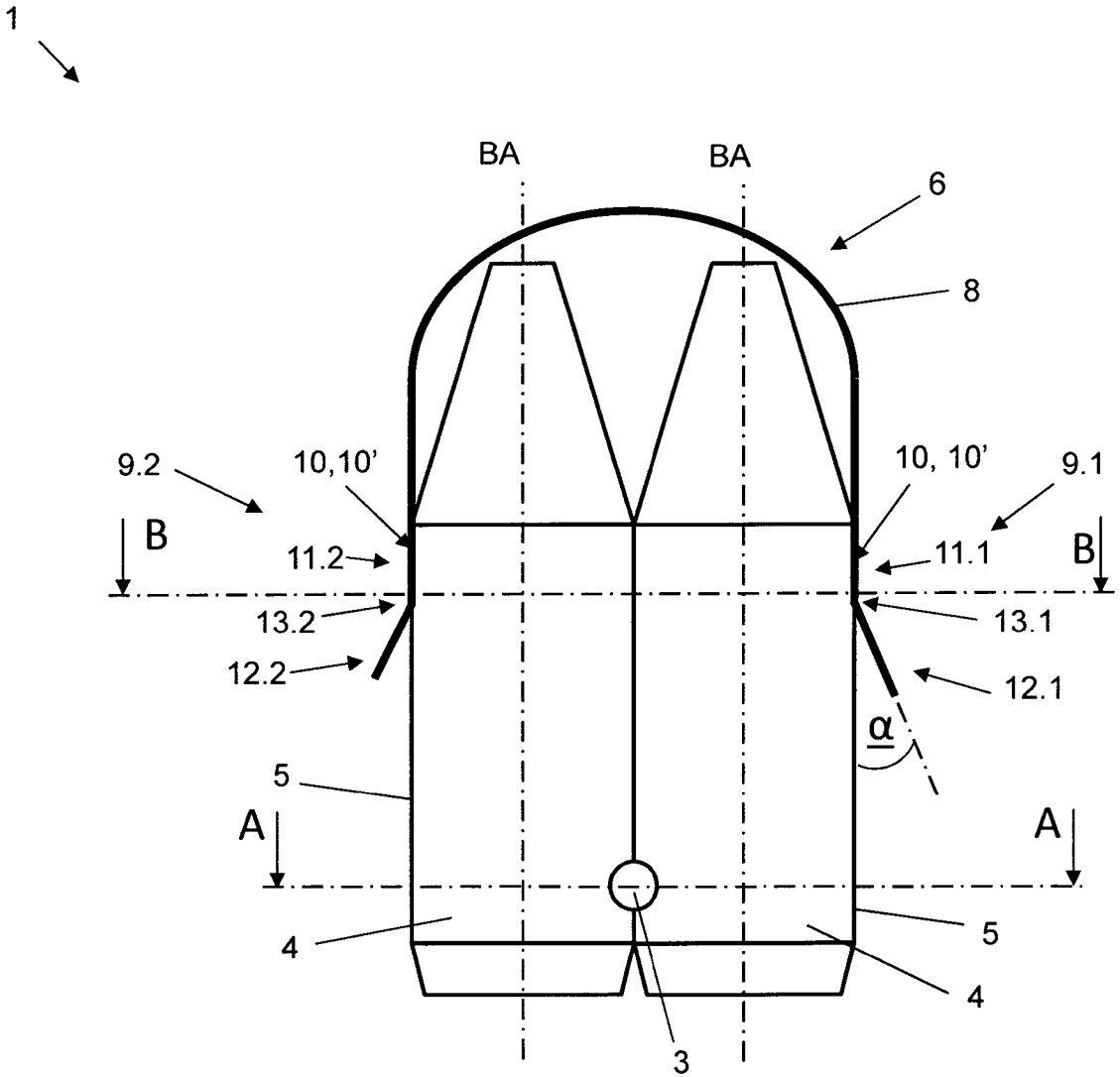
FIGS. 1*a-c* show different views of a container group having a carrying handle.
Figure 1C:
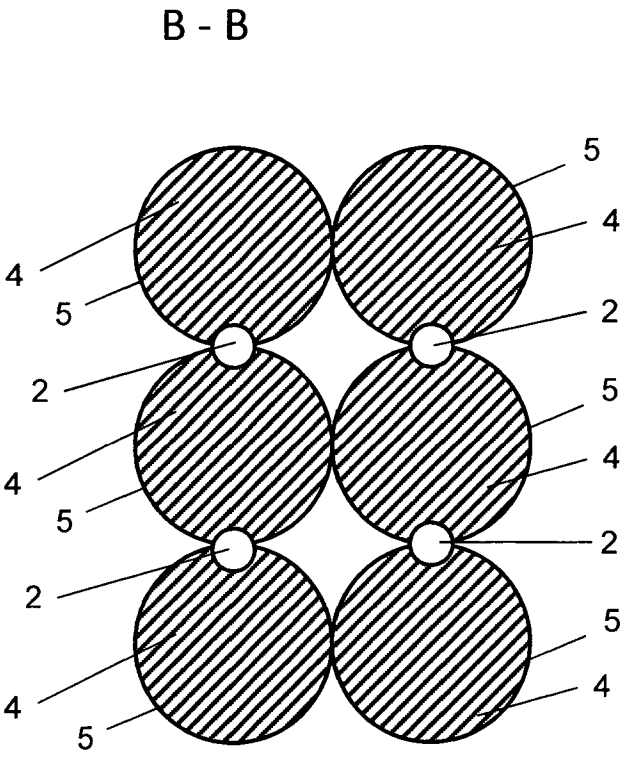
Figure 1B:
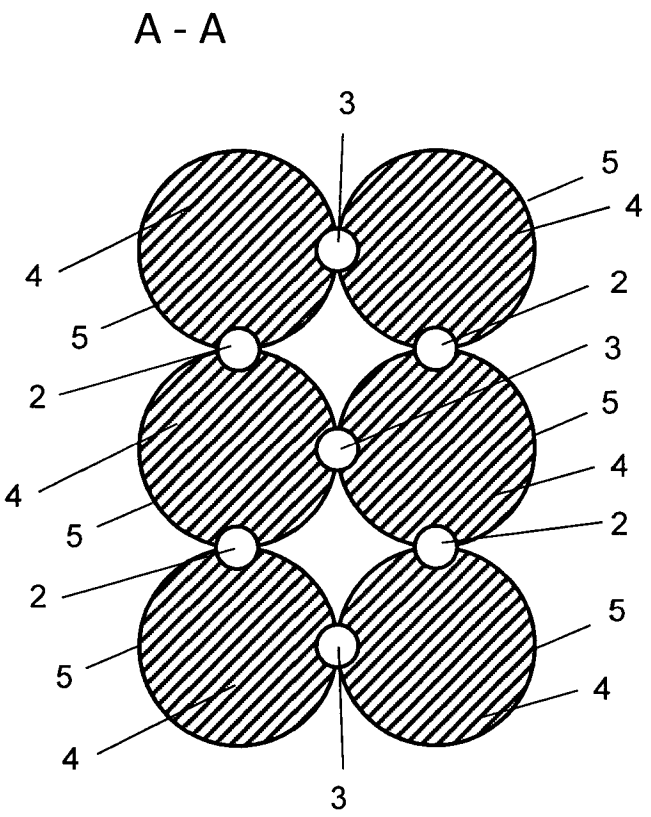

FIG. 1*a* shows a side view of a container group 1 made of containers 4. FIGS. 1*b* and 1*c* show sectional views of the container group 1 along sectional planes A and B respectively.

The illustrated container-group 1 has six containers 4 that are arranged in two rows of three containers 4 each, with all containers 4 having parallel container axes BA. This arrangement forms at least one contact surface between corresponding container surfaces 5 of adjacent containers 4. First and second adhesive layers 2, 3 detachably connect the containers 4 from each other. The adhesive layers 2, 3 are made of a rapidly bonding or hardening glue that has been applied on the container surface 5 in such a way that the first adhesive layers 2 connect containers 4 in the same row and the second adhesive layers 3 connect containers in adjacent container rows.

Figure 2:
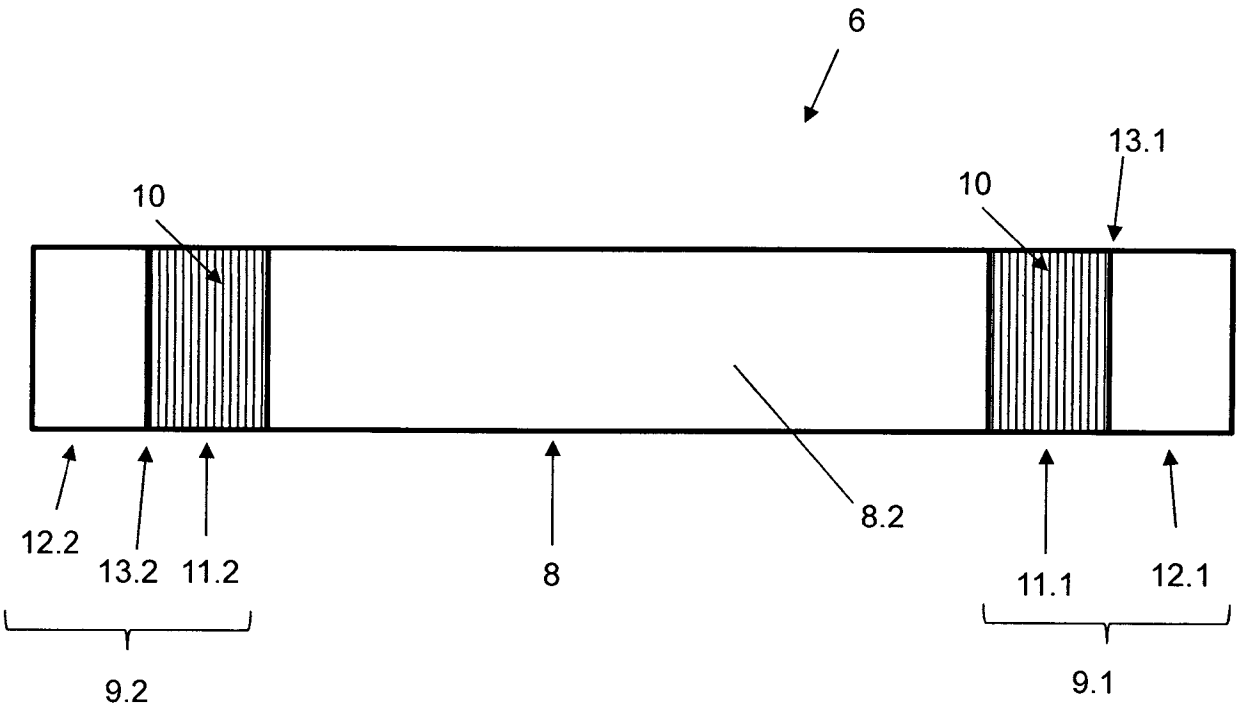
FIG. 2 shows a carrying handle.

The container-group 1 includes a band-like carrier element 8 for formation into a loop-like carrying handle 6. FIG. 2 shows the underside 8.2 of the carrier element 8.

The carrier element 8 has first and second free-ends 9.1, 9.2. The first free-end 9.1 includes a first connecting section 11.1 and a first pull-off tab 12.1 that adjoins the first connecting section 11.1. The second free-end 9.2 includes a second connecting section 11.2 and a second pull-off tab 12.2 that adjoins the second connecting section 11.2. The first and second connecting sections 11.1, 11.2 connect their corresponding first and second free-ends 9.1, 9.2 directly on an outer surface 5 of a container 4.

In some embodiments, the first free-end 9.1 has a first folding-edge 13.1 between the first pull-off tab 12.1 and the first connecting section 11.1. In addition, the second free-end 9.2 has a second folding-edge 13.2 between the second pull-off tab 12.2 and the second connecting section 11.2. The first and second folding-edges 13.1, 13.2 run essentially parallel to the edges of the first and second free-ends 9.1, 9.2 respectively.

The first folding-edge 13.1 forms a separation line between the first pull-off tab 12.1 and the first connecting section 11.1. In particular, the first pull-off tab 12.1 is jointed so that it projects from the outer surface 5 of the container 4 at an angle $\alpha$ of between 0 and 180 degrees, and preferably at an angle $\alpha$ of between 5 and 90 degrees.

Similarly, the second folding-edge 13.2 forms a separation line between the second pull-off tab 12.2 and the second connecting section 11.2. In particular, the second pull-off tab 12.2 is jointed so that it projects from the outer surface 5 of the container 4 at an angle $\alpha$ of between 0 and 180 degrees, and preferably at an angle $\alpha$ of between 5 and 90 degrees. Preferably, the first and second pull-off tabs 12.1, 12.2 are integral with the carrier element 8.

In some embodiments, an adhesive layer 10 on the first and second connecting sections 11.1, 11.2 permits regions surrounding the first and second free-ends 9.1, 9.2 to bond directly to a container's outer surface 5.

As shown in FIG. 2, the adhesive layer 10 is formed only on a portion of the carrier element's underside 8.2 in the region of the first and second free-ends 9.1, 9.2. The corresponding first and second pull-off tabs 12.1, 12.2 thus remain free of adhesive.

As an alternative, it is also possible to place an adhesive layer 10' on the containers' outer surfaces 5. For this purpose, the first and second connecting sections 11.1, 11.2, for example the underside 8.2 of the carrier element 8 connect directly to adhesive layers 10' that are already on the containers' outer surfaces 5.

In some embodiments, an adhesive layer 10 extends over the entire underside 8.2 of the first free-end 9.1. In these embodiments, folding the first free-end 9.1 back in the direction of the second free-end 9.2 forms the first pull-off tab 12.1 and the first connecting section 11.1. Preferably, the first free-end is folded back by 180 degrees. A similar procedure is carried out at the second free-end 9.2 to form the second pull-off tab 12.2 and the second connecting section 11.2. The first and second connecting sections 11.1, 11.2 would then have an adhesive layer 10 that can connect directly to the container's outer surface 5.

In other embodiments, the first free-end 9.1 is folded toward the second free-end 9.2 to form a folded section having a length that is about 25% of its total length. Accordingly, the first connecting section 11.1 will have an adhesive layer 10 that is about twice as long as the first pull-off tab 12.1.

In yet other embodiments, the first free-end 9.1 is folded in a similar manner toward the second free-end 9.2 so as to form a folded section having a length that is about 33% of its total length. In this case, the first connecting section 11.1 and the first pull-off tab 12.1 will be about the same length.

In still other embodiments, an adhesive layer 10 covers the entire underside 8.2 of the first free-end 9.1 in the region that forms the first pull-off tab 12.1 and an additional material piece is bonded on the band-like material of the carrier element 8.

Also among the embodiments are those in which the first pull-off tab 12.1 is formed by having the band-like carrier element 8 have an adhesive layer 10. The adhesive layer 10 is on the first free-end 9.1 only in the region of the first pull-off tab 12.1. The additional material piece is then arranged on this adhesive layer 10. In a particularly advantageous embodiment, the additional band-like material piece is the same width as the carrier element 8 and therefore only needs its length to be cut to conform to the dimensions of the first pull-off tab 12.1.

Although all of the foregoing arrangements are described in terms of the first free-end 11.1 and the first pull-off tab 12.1, similar arrangements can be made for the second free-end 11.1 and the second pull-off tab 12.2 as well.

Figure 3:
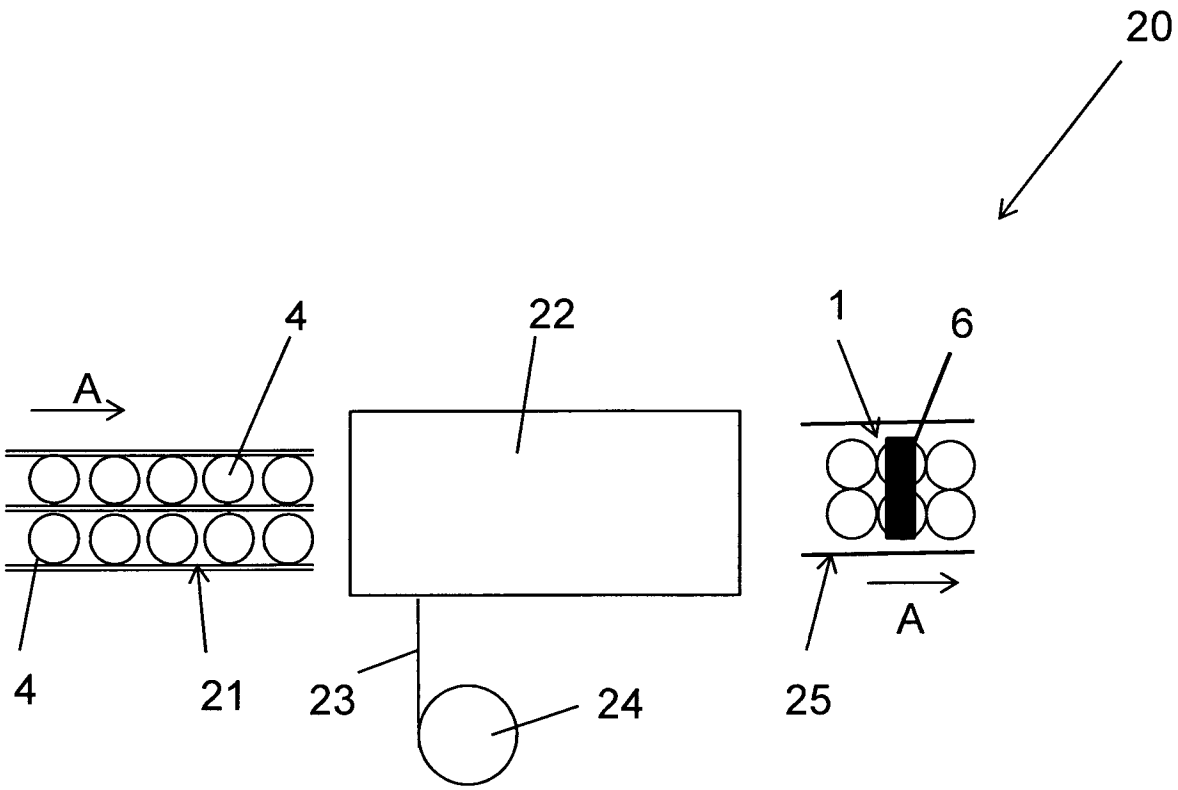
FIG. 3 shows a system for forming the container group and applying the carrying handle.

FIG. 3 shows an apparatus 20 for producing a container-group 1 using any of the foregoing configurations.

The apparatus 20 includes an inbound transporter 21 that conveys a multi-channel container-stream along a transport direction A to a container inlet of a workstation 22. The containers 4 in this container stream have vertically-oriented container axes BA. In some embodiments, the number of channels of this container stream corresponds to the number of container rows of the container-group 1 that is to be formed. Thus, in the embodiment shown in FIG. 3, the inbound transporter 21 conveys a two-channel container stream to make a container group 1 having two rows of containers 4.

The workstation 22 applies glue to form adhesive layers 2, 3 in accordance with the positions shown in FIGS. 1*a* to 1*c* on the outer surfaces 5 of the containers 4. It then converges and compresses the containers 4 to form a container-group 1.

At the same time, the workstation 22 attaches the carrying handle 6 to the container-group 1 by using the adhesive layers 10 already present on the carrying handle 6 or by applying glue to form adhesive layers 10' on either the outer surfaces 5 of the containers 4 and/or the previously described regions of the carrying handle 6.

To make a carrier element 8, the workstation 22 draws band-like material 23 from a storage coil and cuts off the length needed to form the carrying handle 6. In some embodiments, the adhesive layers 10 are already provided on the band-like material 23. In other embodiments, the workstation 22 applies adhesive layers 10' to the outer surfaces 5 of the relevant containers 4 just before connecting the first and second free-ends 9.1, 9.2 concerned to the outer surfaces 5. It does so using nozzles and/or by rotating the containers about their container axes BA.

For those embodiments in which the first and second pull-off tabs 12.1, 12.2 are formed by folding, the work station 22 includes a folding device to fold the respective first and second free-ends 9.1, 9.2 along their respective first and second folding-edges 13.1, 13.2. An outbound transporter 25 then conveys the completed container group 1 in the transport direction A.

The application of the glue and/or adhesive layers 2, 3, 10, 10' can be carried out in a variety of ways. In some cases, the glue or adhesive is a fluid that dries or hardens after application thereof to form the glue and/or adhesive layers 2, 3, 10, 10'. These layers 2, 3, 10, 10' are self-adhesive and/or form an adhesive connection under pressure.

Some embodiments include those that spray the adhesive fluid onto containers' outer surfaces 5 and those that press the fluid onto containers' outer surfaces 5.

In some embodiments, the glue is a hot-melt glue. In these embodiments, the glue is applied, while still hot, through a nozzle and onto a container's outer surface 5 or onto a carrying handle 6.

Yet other embodiments feature forming adhesive layers 2, 3, 10, 10' using adhesive bodies or films, such as adhesive strips or adhesive labels, and in particular, adhesive strips or adhesive labels that have adhesive on both sides. A suitable adhesive strip is one offered by the company tesa SE, 20253 Hamburg, under the trade name "POWERSTRIP®".

Examples of adhesive strips used for the glue and/or adhesive layers 2, 3, 10, 10' and the carrier elements 8 include a temperature-resistant strip-form carrier material such as plastic based on polyethylene, polypropylene, polyester, in particular polyethylene terephthalate, PET, PVC, polyamide or polyimide and/or of paper and/or a composite material of the foregoing substances. This carrier material is then coated with the glue and/or adhesive agent on both sides for making the adhesive layers 2, 3, 10, 10', and on one side for the carrying handles 6. These adhesive strips or adhesive compounds are preferably produced with little or no anisotropy. Corresponding adhesive strips or adhesive compounds and their production are described in DE 10 2005 054 054 A1.

For the glue and/or adhesive locations 2, 3, 10, 10', such glues or adhesive agents that can be hardened by the effect of energy, for example by heating and/or by irradiation, (e.g. infra-red radiation, UV radiation, electromagnetic radiation or microwave energy, by radioactive radiation, by electron or X-ray radiation, etc.) are also suitable. These glue or adhesive agents can in turn be constituent parts of adhesive strips or adhesive compounds, which consist of strip-shaped carrier material. Glue compounds or adhesive strips of the foresaid type and their production are described in DE 103 44 449 A1. In particular, such substances are used as glue or adhesive agents that exhibit good adhesion to the material of the containers, as well as high cohesion (inner strength in the respective glue or adhesive layer), as a result of which good adhesion properties are achieved, and therefore a particularly strong connection between the containers that form the stable container. Such glue and adhesive agents are described in DE 103 23 048 A. It is further advantageous if the glue and adhesive agent are somewhat raised, such that the contact surface on the usually slightly convex container wall is enlarged.

Figure 5:
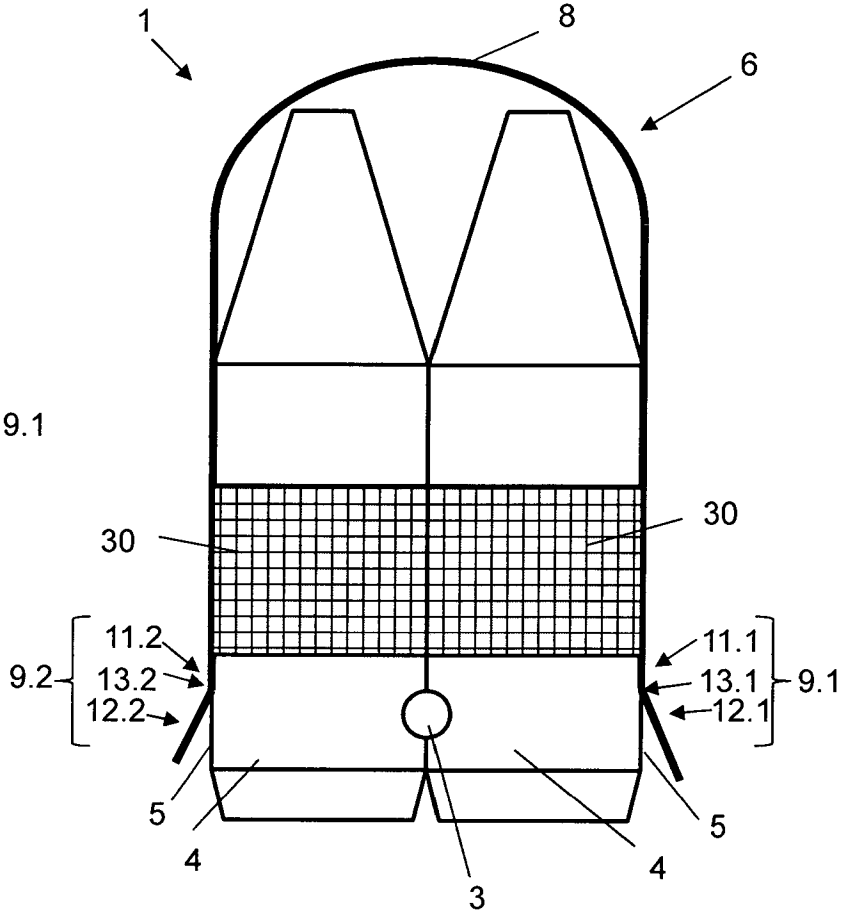
FIG. 5 shows a side view of a further alternative embodiment of a container.
Figure 4:
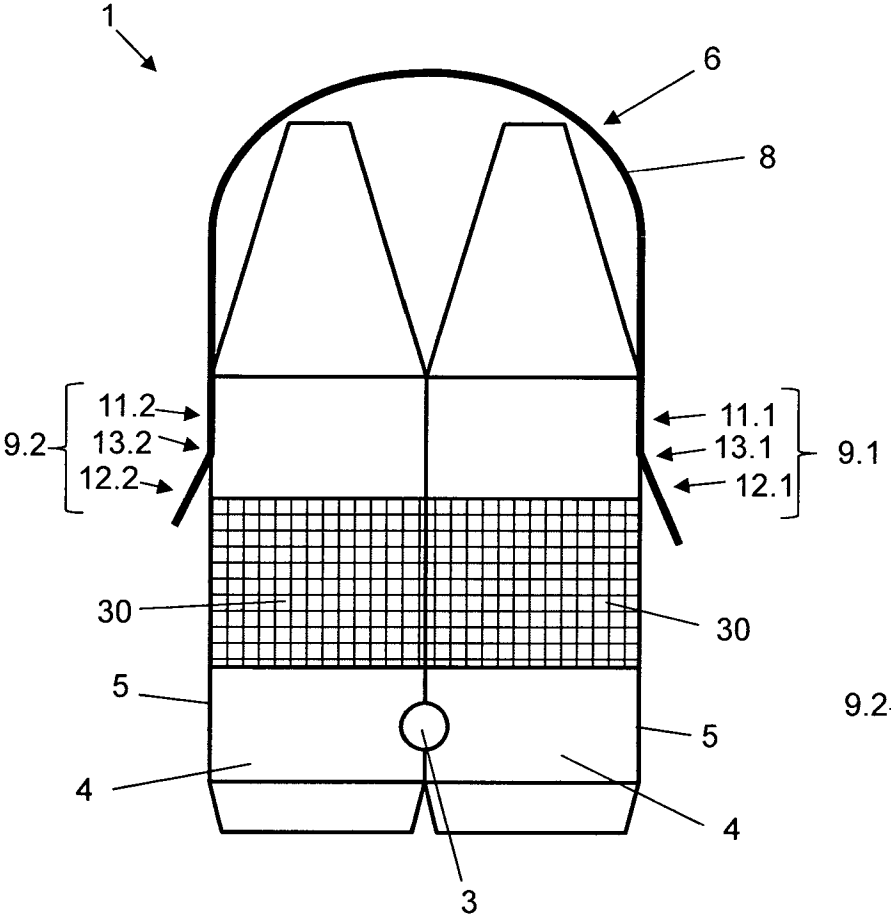
FIG. 4 shows an alternative embodiment of a container group.

FIGS. 4 and 5 show side views of two different embodiments of container groups 1 in which the containers 4 have a decorated region 30 on their outer surfaces 5. The decorated regions 30 can be labels or directly printed images. In the embodiment shown in FIG. 4, the connecting sections 11.1, 11.2 are fixed above the decorated regions 30. In the embodiment shown in FIG. 5, the connecting regions 11.1, 11.2 are fixed below the decorated regions 30.

The invention has been described heretofore by way of a number of exemplary embodiments. It is understood that numerous modifications and changes to the invention are possible without thereby departing from the inventive concept.

Having described the invention, and a preferred embodiment thereof, what is claimed as new and secured by Letters Patent is:

1. A manufacture comprising a container group that comprises containers arranged in rows, a handle formed from a band, said handle being a looped carrying handle having first and second ends, said first end comprising a pull off tab connected to a first connecting section, said second end comprising a second connecting section, said first and second connecting sections being connected to outwardly-facing surfaces of at least some of said containers, first adhesive layers that connect containers that are in the same row, said first adhesive layers being disposed in upper and lower sectional planes, and second adhesive layers connect containers in adjacent rows, said second adhesive layers are disposed only on said lower sectional plane, whereby said lower sectional plane has only second adhesive layers.

2. The manufacture of claim 1, further comprising a folding edge formed between said pull-off tab and said first connecting-section, wherein said first connecting-section adjoins said pull-off tab.

3. The manufacture of claim 1, wherein said pull-off tab projects from said outer surface of one of said adjacent containers at an angle between zero and 180 degrees.

4. The manufacture of claim 1, wherein said pull-off tab projects from said outer surface of one of said adjacent containers at an angle between 5 and 90 degrees.

5. The manufacture of claim 1, wherein said band comprises an underside having an adhesive strip provided in a region of one of said first and second connecting-sections and wherein one of said first and second connecting-sections connects directly to an outer surface of one of said adjacent containers using said adhesive strip.

6. The manufacture of claim 1, wherein said pull-off tab is formed from folding said first free-end along a longitudinal direction of said band.

7. The manufacture of claim 6, wherein said adhesive layer extends over a full surface of said first free-end such that, after having been folded along a longitudinal direction of said band-like carrier-element, said first free-end forms both said pull-off tab and said first connecting-section and wherein said first connecting-section comprises said adhesive layer.

8. The manufacture of claim 1, wherein said pull-off tab is integral with said band.

9. The manufacture of claim 1, wherein at least one of said adjacent containers comprises said adhesive layer arranged on a surface thereof and wherein at least one of said first and second connecting-sections connects directly to said surface via said adhesive layer.

10. A method comprising producing a container group that comprises rows of containers, wherein producing said container group comprises joining adjacent containers in the same row by adhesive layers disposed in upper and lower sectional planes, joining adjacent containers in different using only adhesive layers that are in said lower sectional plane, forming a handle from a band, said handle being a looped carrying handle having first and second free-ends, said first and second free-ends having corresponding first and second connecting-sections, connecting said first connecting-section to an outwardly-facing surface of a first container from said container group so as to form a pull-off tab at said first free-end, said pull-off tab being connected to said first connecting-section, and connecting said second connecting-section to an outwardly-facing surface of a second container from said container group.

11. The method of claim 10, further comprising applying a second adhesive layer onto a region of at least one of said first and second connecting-sections and gluing at least one of said first and second free-ends directly to an outwardly-facing of one of said first and second containers.

12. The method of claim 10, further comprising placing a second adhesive-layer onto an outwardly-facing surface of said first container and, using said second adhesive-layer, gluing said first connecting-section to an outwardly-facing surface of one of said first and second containers.

13. The manufacture of claim 1, wherein said outwardly-facing surfaces of containers are convex and said adhesive layers are raised.

14. The manufacture of claim 1, wherein the product of the number of second adhesive layers in said upper sectional plane and the number of first adhesive layers in said upper sectional plane is zero.

15. The manufacture of claim 1, wherein all adhesive layers that connect containers in adjacent container rows are on said lower sectional plane.

16. The manufacture of claim 1, wherein said adhesive layers comprise strips, each of which has an adhesive on both sides thereof.

17. The manufacture of claim 1, wherein said adhesive layers comprise adhesive labels.

18. A manufacture in which a handle is in combination with a container group in which containers are arranged in rows, wherein first adhesive layers, which connect containers that are in the same row, are disposed in upper and lower sectional planes, wherein second adhesive layers, which connect containers in adjacent rows, are disposed on said lower sectional plane, wherein said upper sectional plane is free of said second adhesive layers, wherein said handle, which is formed from a band, is a looped carrying handle having a first end that has a pull off tab that connects to a first connection section and a second end that has a second connecting section, said first and second connecting sections being connected to outwardly-facing surfaces of at least some of said containers.

19. The manufacture of claim 18, wherein adhesive layers are disposed on said upper sectional plane, wherein said adhesive layers consist of only said first adhesive layers.

* * * * *